US008516761B2

(12) United States Patent
Laiho et al.

(10) Patent No.: US 8,516,761 B2
(45) Date of Patent: Aug. 27, 2013

(54) EXPANSION JOINT SYSTEM OF CONCRETE SLAB ARRANGEMENT

(75) Inventors: Topi Laiho, Lahti (FI); Trent Davis, Roborough (GB)

(73) Assignee: Peikko Group Oy, Lahti (FI)

( * ) Notice: Subject to any disclaimer, the term of this patent is extended or adjusted under 35 U.S.C. 154(b) by 150 days.

(21) Appl. No.: 12/680,042

(22) PCT Filed: Jan. 20, 2009

(86) PCT No.: PCT/FI2009/050051

§ 371 (c)(1),
(2), (4) Date: May 5, 2010

(87) PCT Pub. No.: WO2009/092858

PCT Pub. Date: Jul. 30, 2009

(65) Prior Publication Data

US 2010/0281808 A1 Nov. 11, 2010

(30) Foreign Application Priority Data

Jan. 21, 2008 (FI) ..... 20085045

(51) Int. Cl.
*E04B 1/48* (2006.01)
*E04B 1/68* (2006.01)

(52) U.S. Cl.
USPC ..... 52/334; 52/340; 52/341; 52/396.05; 52/322; 404/66; 404/59

(58) Field of Classification Search
USPC ..... 52/333, 334, 338, 340, 341, 319, 52/322, 396.05, 396.04; 404/59, 66, 60, 404/87, 88, 47
See application file for complete search history.

(56) References Cited

U.S. PATENT DOCUMENTS

| | | | | | |
|---|---|---|---|---|---|
| 1,307,224 | A | * | 6/1919 | Weber | 52/410 |
| 1,343,659 | A | * | 6/1920 | Christin | 52/322 |
| 2,029,817 | A | * | 2/1936 | Fegles | 52/371 |
| 2,138,817 | A | * | 12/1938 | Jacobson | 404/55 |
| 2,166,220 | A | * | 7/1939 | Older | 404/58 |
| 2,466,106 | A | * | 4/1949 | Hoge | 52/483.1 |
| 2,508,443 | A | * | 5/1950 | Carter | 404/60 |
| 3,094,813 | A | * | 6/1963 | Van Rensselaer | 52/344 |
| 3,564,799 | A | * | 2/1971 | Hanson | 52/334 |

(Continued)

FOREIGN PATENT DOCUMENTS

| | | |
|---|---|---|
| EP | 0 773 324 A1 | 5/1997 |
| EP | 1 389 648 A1 | 2/2004 |

(Continued)

OTHER PUBLICATIONS

Finnish Search Report for Finnish Application No. 20085045, Oct. 21, 2008 (w/ English translation).

(Continued)

*Primary Examiner* — Phi A
(74) *Attorney, Agent, or Firm* — Oliff & Berridge, PLC

(57) ABSTRACT

The invention relates to an expansion joint system of a concrete slab arrangement, comprising an expansion joint reinforcement to be arranged between a first and a second concrete slab, the expansion joint reinforcement comprising at least one local or continuous dowel arranged to transfer loads which are perpendicular to the slab plane. A shear reinforcement or a location for attaching the shear reinforcement has been arranged in advance in the expansion joint reinforcement.

10 Claims, 11 Drawing Sheets

(56) References Cited

U.S. PATENT DOCUMENTS

| | | | | |
|---|---|---|---|---|
| 4,332,504 | A * | 6/1982 | Arai | 404/68 |
| 4,616,464 | A * | 10/1986 | Schleich et al. | 52/834 |
| 4,696,137 | A * | 9/1987 | Schleich | 52/251 |
| 4,741,138 | A * | 5/1988 | Rongoe, Jr. | 52/334 |
| 5,978,997 | A * | 11/1999 | Grossman | 14/73 |
| 6,775,952 | B2 * | 8/2004 | Boxall et al. | 52/396.05 |
| 8,091,306 | B2 * | 1/2012 | Kerrels | 52/396.05 |
| 8,112,959 | B2 * | 2/2012 | Michiels | 52/396.05 |

FOREIGN PATENT DOCUMENTS

| | | |
|---|---|---|
| FI | 110631 B | 2/2003 |
| FI | l6036 | 11/2003 |
| FI | 6124 | 2/2004 |
| FI | l6759 | 7/2005 |
| FI | 116154 B | 9/2005 |
| WO | WO 00/23653 | 4/2000 |

OTHER PUBLICATIONS

International Search Report and Written Opinion for International Application No. PCT/FI2009/050051, mailed on May 18, 2009.

* cited by examiner

Fig. 7
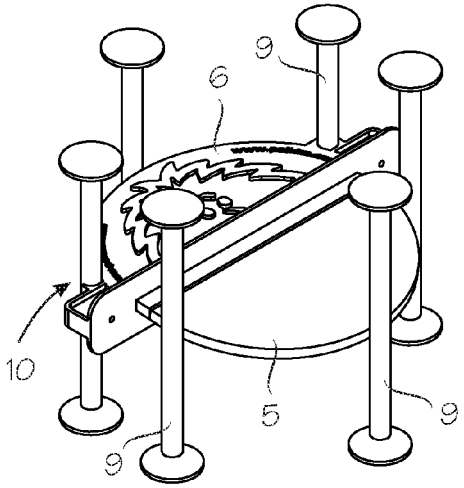
Fig. 8
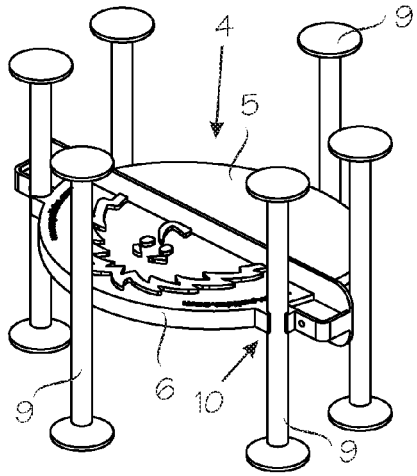
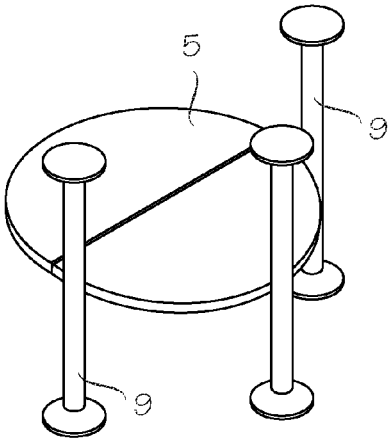
Fig. 9
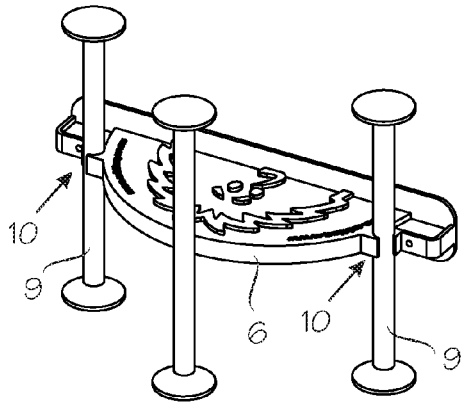
Fig. 10

Fig. 11
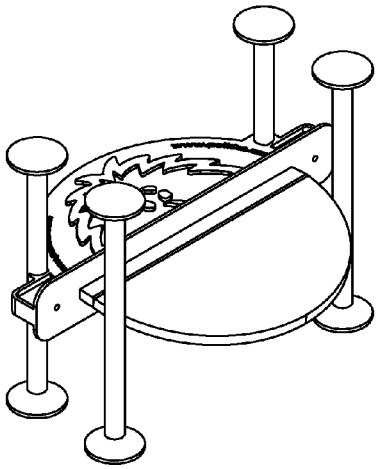
Fig. 12
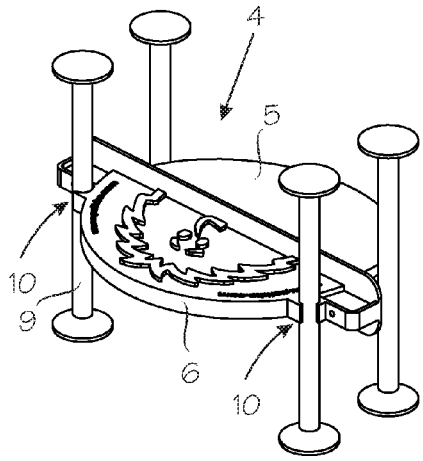
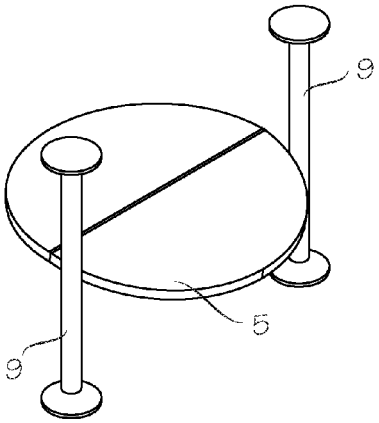
Fig. 13
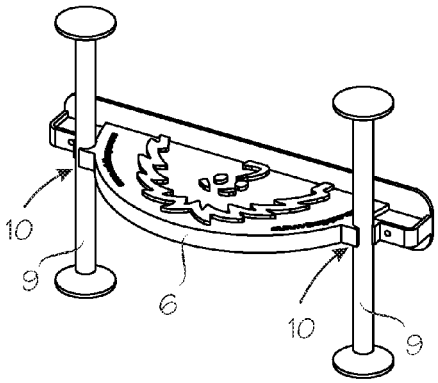
Fig. 14

EXPANSION JOINT SYSTEM OF CONCRETE SLAB ARRANGEMENT

The invention relates to an expansion joint system of a concrete slab arrangement, comprising an expansion joint reinforcement to be arranged between a first and a second concrete slab, the expansion joint reinforcement comprising at least one local or continuous dowel arranged to trans-fer loads which are perpendicular to the slab plane.

Expansion joint reinforcements are mainly used in connection with ground slab arrangements. Ground slab arrangements are structures formed of concrete slabs and cast directly in place upon a sand bed on the construction site.

It is preferable to make the slabs used in ground slab arrangements as thin as possible, whereby the consumption of concrete remains as small as possible.

The slabs of ground slab arrangements are supported against the ground. Although the ground under the slab is made as compact as possible, its load-carrying capacity is not uniform. Therefore, even a thin ground slab must be capable of dividing point load, for example, over a wider area so that no local dents are generated in the slab. Due to this, a ground slab is usually provided with a steel wire net to be installed halfway of its thickness. The wire net also evens out the stresses caused by the shrinking of the slab.

Usually it is necessary to cover relatively large areas by means of ground slab arrangements. Due to the shrinkage and thermal movements of concrete, large areas must be divided into smaller parts with expansion joints. An expansion joint must allow adjacent slabs of the arrangement to move horizontally relative to each other due to shrinkage and thermal movements. These movements mean here movements that are in the direction of the joint and perpendicular to the joint. In contrast, vertical movements perpendicular to the slab plane must be prevented, in other words the joint must be capable of transferring vertical load between the slabs of a slab arrangement.

The joint points are the weakest parts in slab arrangements because a slab is not capable of dividing a load at the edge over a wide area in the ground. In other words, local dents may be generated. Another significant aspect is splitting of the slab edge, for example under a wheel load.

The structures in the joint must also stay in place, i.e. stay adhered to the concrete even if the surrounding concrete wore down. This shows particularly when wheel loads are directed at the joint.

Before the expansion joint reinforcements presently on the market, it was, for example, sawing of a large cast slab into smaller parts after casting that was used. However, sawing was slow and expensive, and the edges of the joint would also break up.

A second example of the above-mentioned old techniques is the use of angle irons to be pressed into the cast after sawing. Disadvantages of this technique were its slowness, high costs, and also determination of the right timing so that the concrete would not harden too much, in other words it was difficult to know whether the angle iron would still adhere to the concrete and stay there in load situations.

A third example is the use of through tenons, i.e. bars to be installed at the edge of a concrete cast. The intention was to reduce adhesion at one end of the bars, for example by means of bituminization. However, a disadvantage was the slow installation in the mould because it was necessary to make holes in the mould. There was also the problem of high costs and, in addition, practical difficulties in installing, for instance due to the fact that the bars had to be exactly parallel so as not to prevent the shrinking movements of the slab.

To eliminate problems of the above solutions, a wide variety of expansion joint reinforcement solutions differing from each other have been provided in the field. The above expansion joint reinforcement solutions known in the field are represented by, for example, the solutions disclosed in FI patent publications 110631 and 116154 as well as FI utility models 6759, 6124 and 6036.

The expansion joint reinforcement solutions described above transfer from one slab to another forces in the direction perpendicular to the surface of the slab. The solutions also allow horizontal movements between the slabs. The load transfer capacity of the expansion joints has been implemented by providing a dowel in the mid-area of the slab height either by means of a steel plate or by shaping a concrete dowel. The dowel may be formed of at least one local plate dowel, such in the solution of FI patent publication 110631, or of a continuous dowel made of concrete, such as in the solution of FI patent publication 116154.

The dowel divides, in the direction of height, the concrete slab into different parts which function separately and do not support each other in load situations. It is to be noted that although it looks thin, a steel dowel has, nevertheless, higher load transfer capacity than the concrete parts divided by the dowel. The weakest point, i.e. the determining factor in the load transfer capacity, is the concrete part either in the dowel or above or below the dowel.

As regards FI utility model 6036, it can be mentioned that in this solution there is not only a continuous dowel but also a pin arrangement in the horizontal direction. This does not prevent the concrete from breaking up above or below the dowel. A vertical pin arrangement is intended for fitting the joint in place and it does not prevent the concrete from breaking up above or below the dowel either.

The capacity of the above known solutions can be increased by means of additional reinforcement. However, additional reinforcing is handwork to be done on the construction site, and it is slow and expensive. There is also the risk of the additional reinforcement being installed too far away from the dowel, in which case it does not function at all or functions poorly. The use of additional reinforcement may also require the use of a thicker slab, which, in turn, greatly increases the costs because concrete is expensive. Loop reinforcement cannot be made very low without loosing steel strength because concrete reinforcing irons have rather large bending radii.

An object of the invention is to provide an expansion joint system of a concrete slab arrangement, by means of which disadvantages of the prior art can be eliminated. This is achieved with an expansion joint system of a concrete slab arrangement according to the invention. The expansion joint system of a concrete slab arrangement according to the invention is characterized in that a shear reinforcement or a location for attaching the shear reinforcement has been arranged in advance in the expansion joint reinforcement.

An advantage of the expansion joint system of a concrete slab arrangement is that the shear capacity of the concrete parts above and below the expansion joint dowel can be increased without laborious additional reinforcement to be installed on the construction site. An advantage of the invention is its simplicity, which results in low manufacturing costs. Savings are also obtained from the work stages needed on the construction site being substantially simple. It is also an advantage of the invention that the invention can be applied in connection with various dowel solutions, such as individual dowels installed locally on the construction site and continuous dowels as well as all kinds of expansion joint reinforcements.

In the following, the invention will be examined in greater detail with reference to the embodiment examples shown in the attached drawing, whereby FIG. 1 shows a principled side view of an embodiment of an expansion joint system according to the invention;

FIG. 3 shows a perspective view of the embodiment according to FIGS. 1 and 2;

FIGS. 7 and 8 show an embodiment of the dowel of an expansion joint according to the invention as views seen from different directions;

FIGS. 9 and 10 show parts of the embodiment according to FIGS. 7 and 8;

FIGS. 11 and 12 show a second embodiment of the dowel of an expansion joint according to the invention as views seen from different directions;

FIGS. 13 and 14 show parts of the embodiment according to FIGS. 11 and 12;

FIGS. 1 to 6 show an embodiment of an expansion joint system of a concrete slab arrangement according to the invention. FIGS. 1 to 4 show the basic parts of the system as such, while FIGS. 5 and 6 show a case where the system of FIGS. 1 to 4 is arranged in connection with two concrete slabs.

Figure 1:
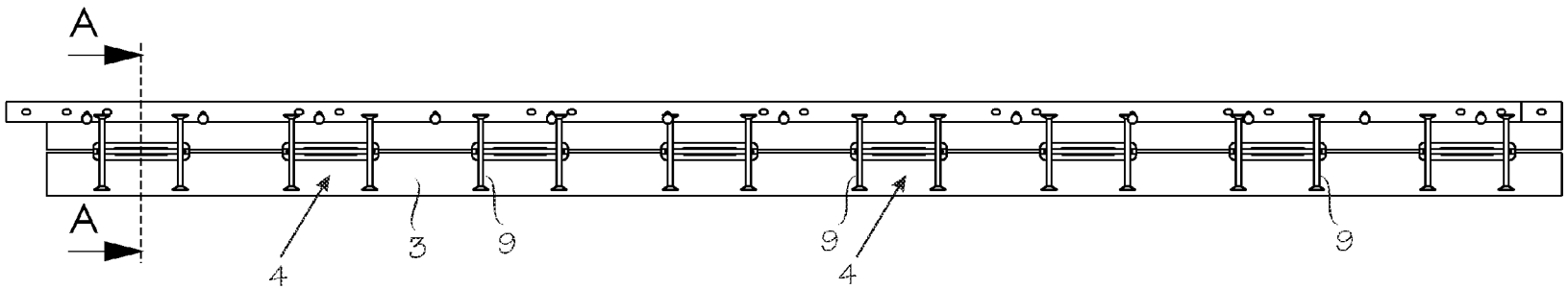
Figure 2:
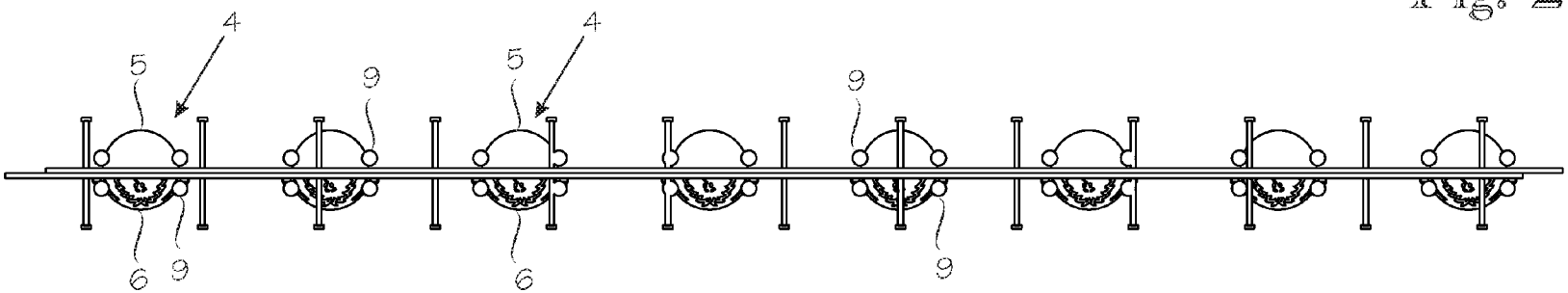
FIG. 2 shows a principled top view of the embodiment of FIG. 1.

In FIGS. 1 to 6, reference numerals 1 and 2 denote concrete slabs, and reference numeral 3 denotes a plate part having a dowel 4 attached to it. The dowel 4 is formed of a dowel plate 5 and a casing part 6.

In the embodiment of FIGS. 1 to 6, reference numeral 7 further denotes a reinforcement arranged at the upper edge of the slab and also comprising a horizontal reinforcement part 8.

Figure 5:
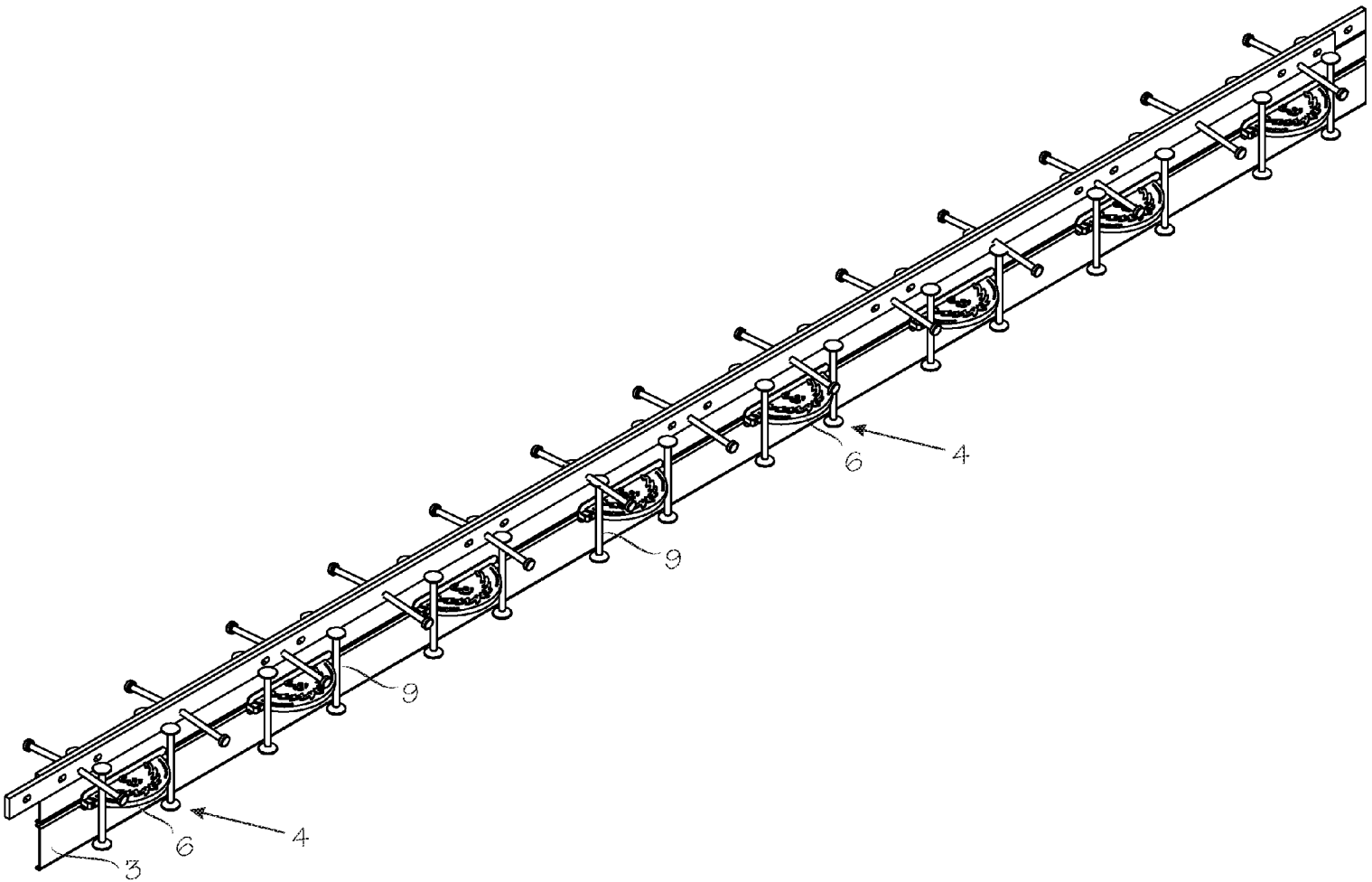
FIG. 5 shows a principled and partial side view of the embodiments according to FIGS. 1 to 4, installed in connection with two concrete slabs.
Figure 4:
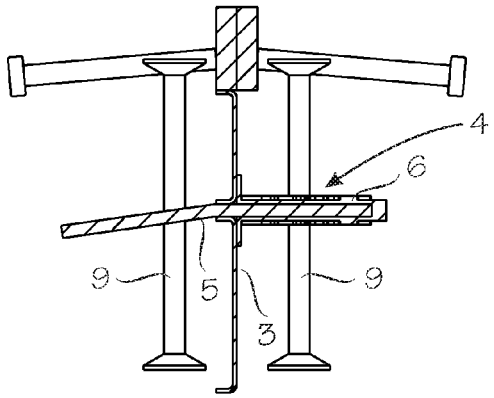
FIG. 4 is a cut-away view of FIG. 1 according to arrows A-A.
Figure 5:
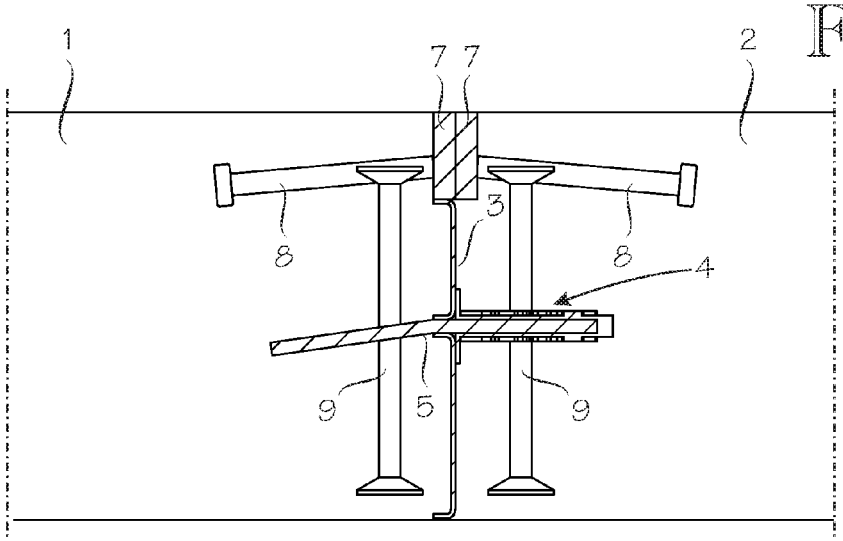
Figure 6:
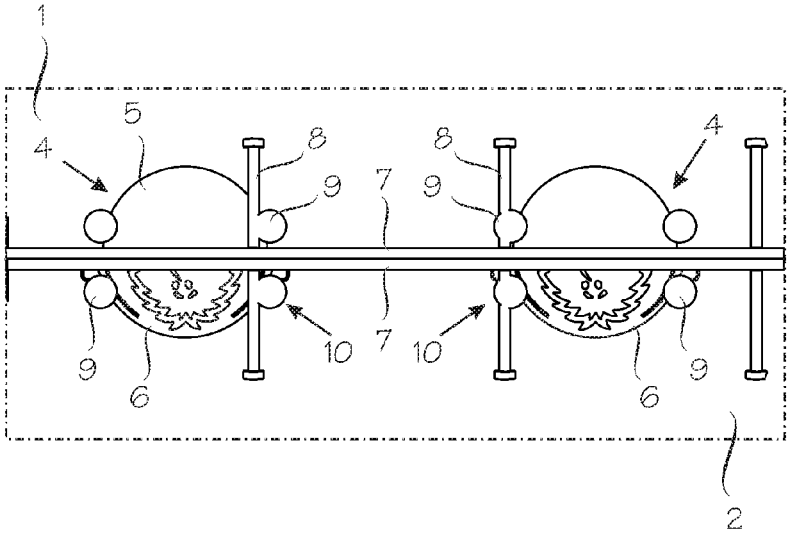
FIG. 6 shows a top view of the embodiment of FIG. 5.
Figure 15:
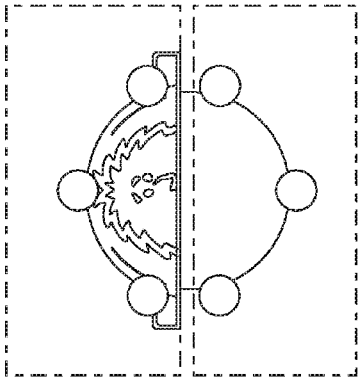
FIGS. 15 to 19 show principled top views of different alternative solutions of the dowel of an expansion joint according to the invention.
Figure 16:
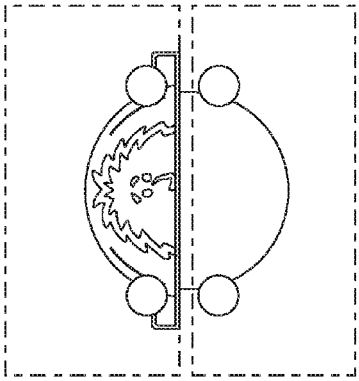
Figure 17:
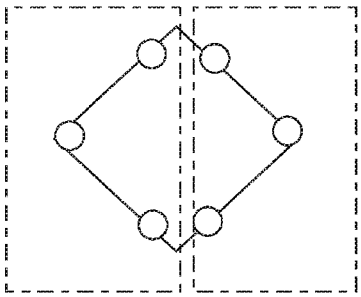
Figure 18:
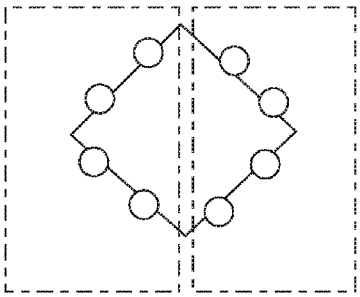
Figure 19:
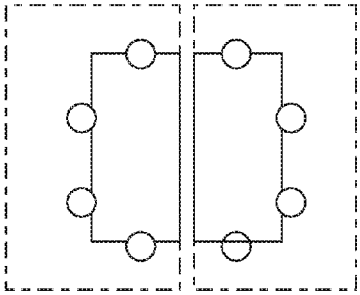

The dowel plate 5 of the dowel 4 is attached to the first concrete slab 1 in such a way that its one edge protrudes from the edge of the concrete slab 1. The part protruding from the edge of the concrete slab 1 and extending to the other side of the joint to the concrete slab 2 is prevented from adhering to the concrete slab 2 by means of the casing part 6. The casing part 6 can be manufactured of plastic material, for example. On the side of the concrete slab 1, the dowel plate 5 adheres to the concrete. When the concrete slabs 1, 2 are shrinking, the dowel plate moves inside the casing part 6 and allows subsequently the movements of the slab also in the longitudinal direction of the joint. The dowel has been arranged in place at the joint by, for example, fitting a structure according to FIG. 4 in place in the mould before casting. The plate part 3 and the reinforcement 7 thus function as the edge of the mould, whereby after the casting a joint is provided between the slabs 1, 2, as shown in FIG. 5.

However, the dowels do not have to be fixed to the expansion joint reinforcement but they may also be individually installed on the construction site, in other words the invention may also be applied in such a way that at first, only one slab is cast on the construction site and moulded with plywood, to which the casing parts are attached. After the cast has been hardened, the plywood is taken off, the casing parts being thus fixed to the cast, whereby dowels can be installed in them. After this, another slab can be cast and so on.

The above dowel structure allows the slabs to move in the horizontal direction of the slabs, as described earlier.

The above dowel structure and its functioning in an expansion joint belong to conventional technology known by a person skilled in the art, so these aspects are not described in greater detail in this context. In this context, reference is made to FI patent publication 110631, for example.

In accordance with an essential idea of the invention, the dowel 4 has been provided in advance with a shear reinforcement 9 or a location 10 for attaching the shear reinforcement. As shown in the figures, the shear reinforcement can be positioned in both the dowel plate 5 and the casing part 6 of the dowel 4.

The number of shear reinforcements is not restricted in any way but it may vary freely according to the need. FIGS. 7 to 14 show examples of different potential variations of the embodiment of FIGS. 1 to 6. The location 10 for attaching the shear reinforcement is clearly seen in FIGS. 12 and 14, for example.

The invention is not, by any means, restricted to the shape of the dowel plate 5 and casing part 6 of the dowel 4 but different shapes are feasible. FIGS. 15 to 19 show different potential variations. Other dowel shapes are naturally also feasible.

In the examples according to FIGS. 1 to 19, the shear reinforcement 9 is formed by means of double-ended clenching pins. The clenching pins are, in the examples of the figures, attached to the dowel 4 by the area between their ends in such a way that the clenching pin extends to both sides of the dowel in the vertical direction. Using clenching pins is advantageous not only in regard of good reinforcing properties but also in that the installing is easy.

Figure 20:
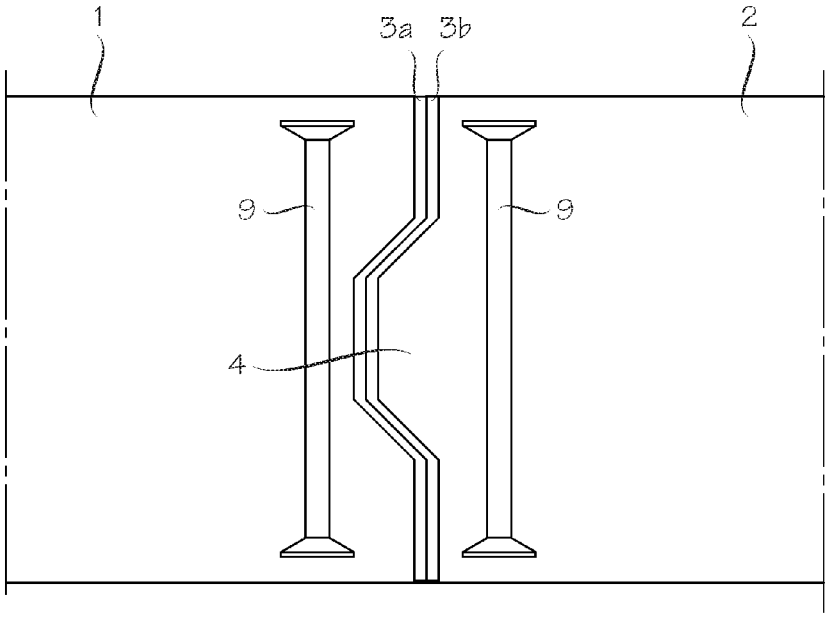
FIG. 20 shows the expansion joint system of a concrete slab arrangement according to the invention, arranged in connection with a continuous dowel and seen from the direction of the joint.
Figure 21:
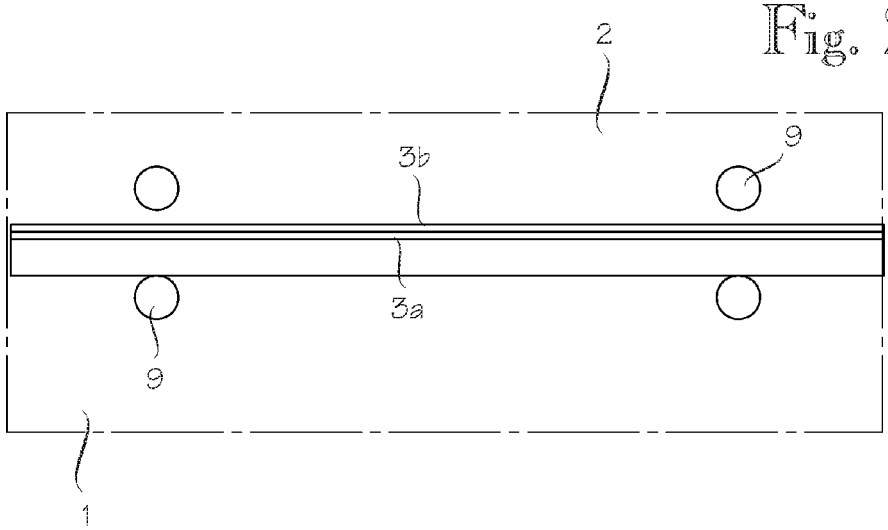
FIG. 21 shows a top view of the embodiment according to FIG. 20.

As described above, the invention is not, by any means, restricted to local dowels shown in FIGS. 1 to 19 but it may also be applied in connection with continuous dowels. FIGS. 20 and 21 show an example of applying the invention in connection with a continuous dowel 4. In this embodiment, the continuous dowel 4 is formed of concrete by utilizing a plate part 3, whereby the dowel 4 is formed of concrete and plate parts 3*a*, 3*b*. The shear reinforcement 9 is attached to the plate parts 3*a*, 3*b*. The plate parts 3*a* and 3*b* as well as the shear reinforcement 9 are arranged in place in the mould before casting, whereby after the casting a joint is generated between the concrete slabs 1, 2 in the structure, the joint having in the horizontal direction, due to the dowel 4, expansion properties similar to those in FIGS. 1 to 19. The invention may also be applied in connection with a continuous dowel made of steel.

However, the invention is not, by any means, restricted to clenching pins but may be applied in connection with other shear reinforcements as well. FIGS. 22 to 25 show examples of other versions of the invention.

Figure 22:
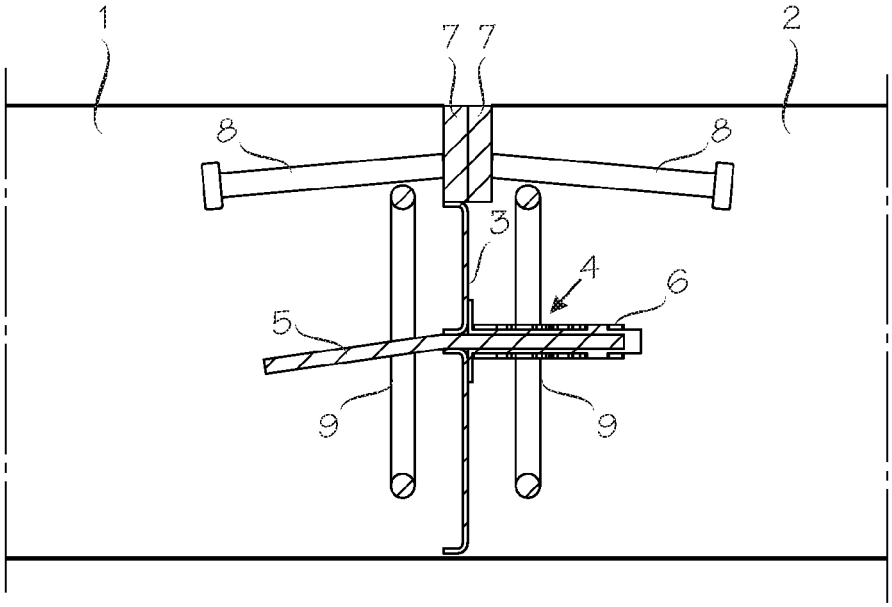
FIG. 22 shows a second embodiment of the expansion joint system according to the invention, installed in connection with two concrete slabs and seen from the direction of the joint.
Figure 23:
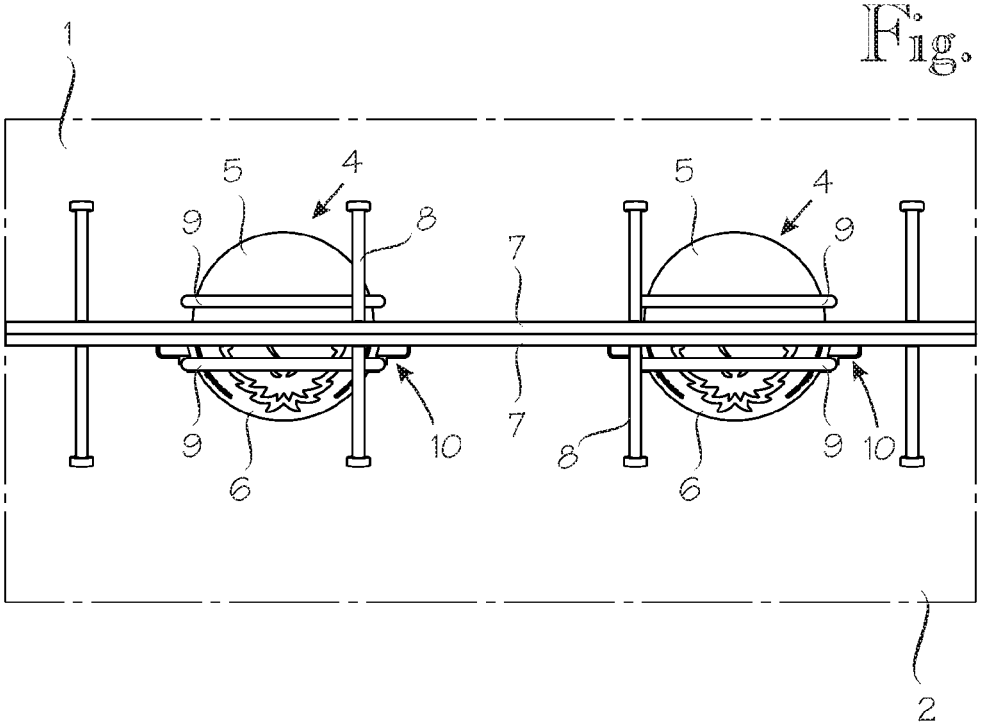
FIG. 23 shows a top view of the embodiment of FIG. 22.

FIGS. 22 and 23 show an embodiment of the invention where the shear reinforcement 9 is formed by means of circular elements, i.e. what are called web reinforcements. In this embodiment, the circular elements are attached to the dowel 4 by the area between the ends of their vertical parts.

Figure 24:
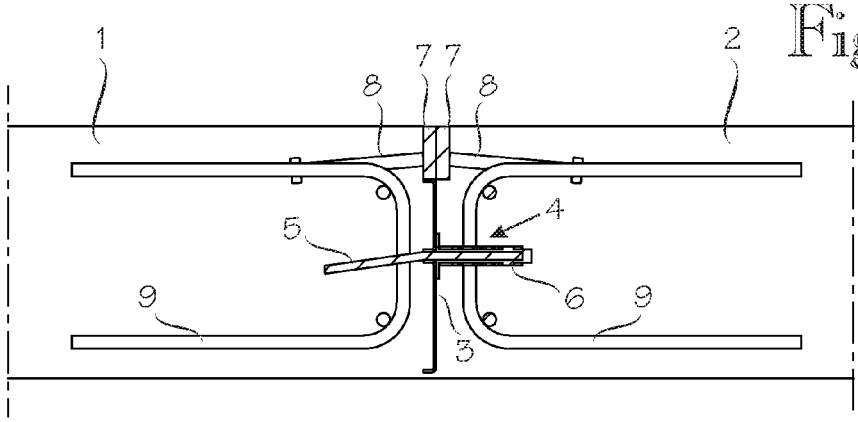
FIG. 24 shows a third embodiment of the expansion joint system according to the invention, installed in connection with two concrete slabs and seen from the direction of the joint.
Figure 25:
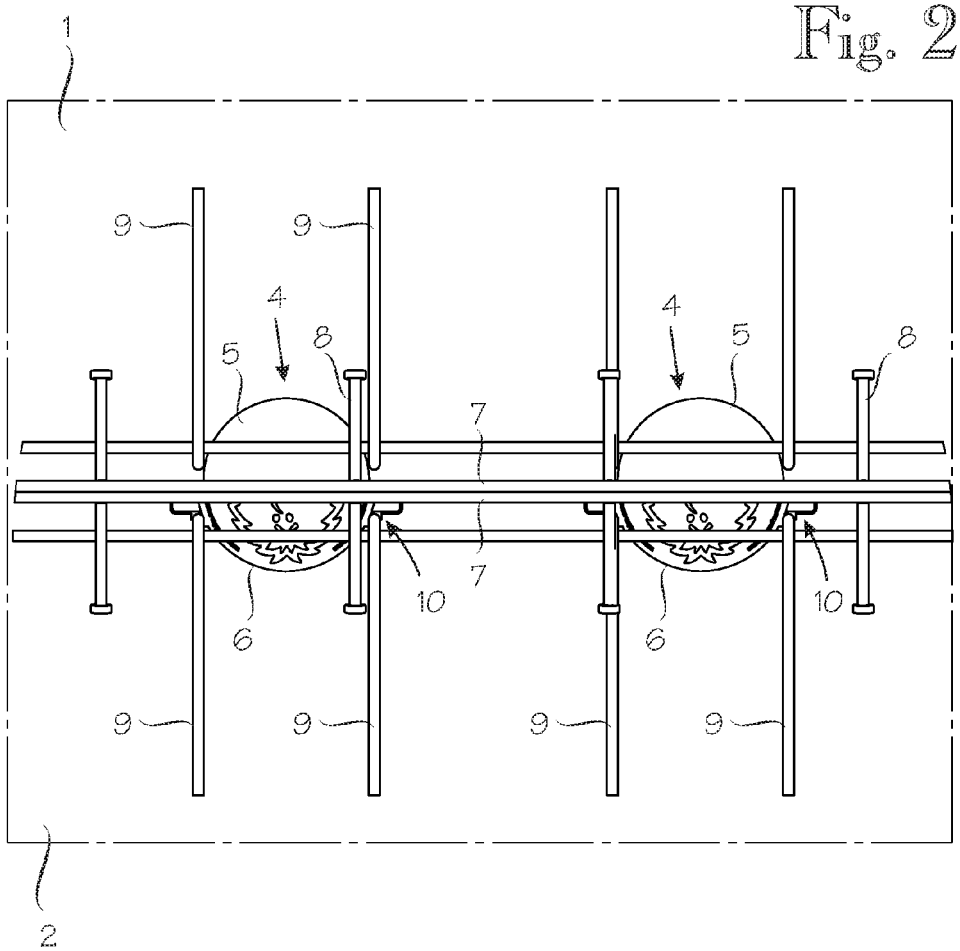
FIG. 25 shows a top view of the embodiment of FIG. 24.

FIGS. 24 and 25 show an embodiment of the invention where the shear reinforcement 9 is formed of substantially U-shaped elements. In this embodiment, the U-shaped elements are attached to the dowel 4 by the area between the ends of the part connecting the branches.

In the above embodiment examples, the shear reinforcement or the location for attaching the shear reinforcement are arranged in the dowel. This is not, however, the only option but the shear reinforcement or the location for attaching the shear reinforcement may also be arranged in a shear reinforcement part other than the dowel.

Figure 26:
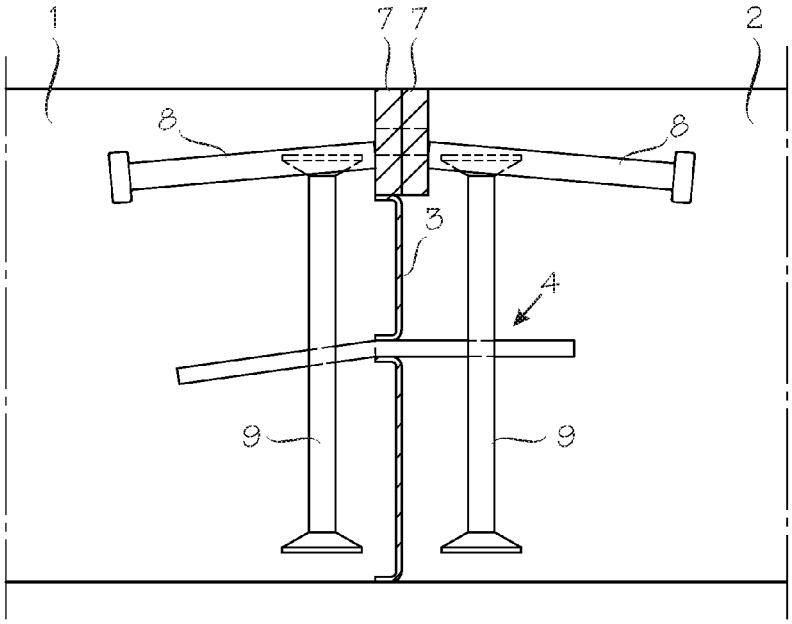
FIG. 26 shows a fourth embodiment of the expansion joint system according to the invention, installed in connection with two concrete slabs and seen from the direction of the joint.
Figure 27:
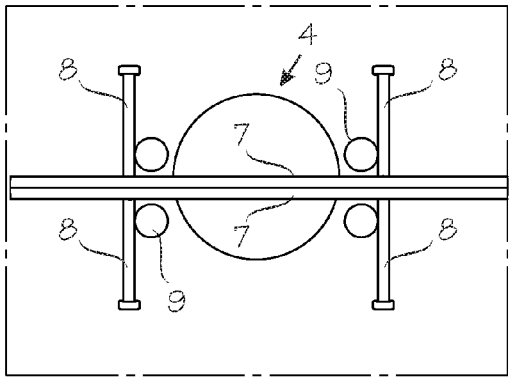
FIG. 27 shows a top view of the embodiment of FIG. 26.
Figure 28:
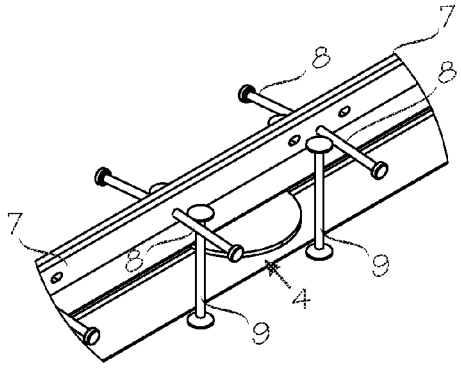
FIG. 28 shows a perspective view of the embodiment of FIGS. 25 and 26.

FIGS. 26 to 28 show a fourth embodiment of the invention. In these figures, the same reference numerals are used at corresponding points as in the previous examples. In the embodiment of FIGS. 26 to 29, the shear reinforcements 9 are arranged by their clenched ends in horizontal reinforcement parts 8. The dowel 4 has a structure similar to that in the previous examples. The shear reinforcements 9 extend to both sides of the dowel 4.

Figure 29:
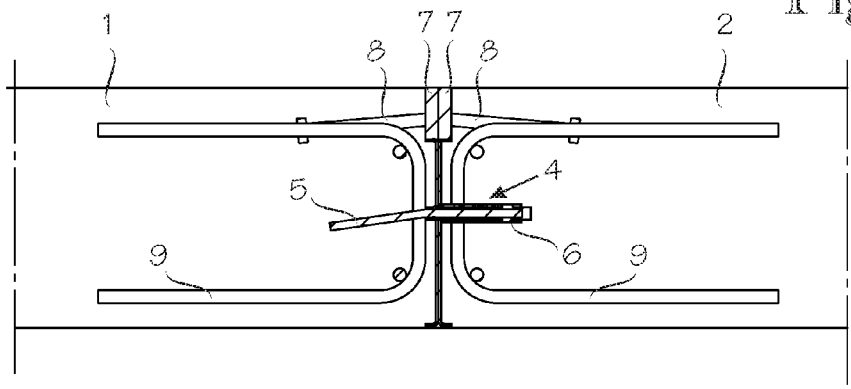
FIG. 29 shows a fifth embodiment of the expansion joint system according to the invention, installed in connection with two concrete slabs and seen from the direction of the joint.
Figure 30:
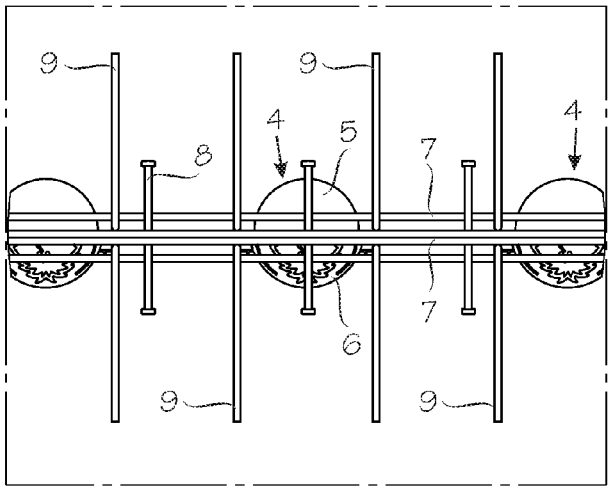
FIG. 30 shows a top view of the embodiment of FIG. 29.
Figure 31:
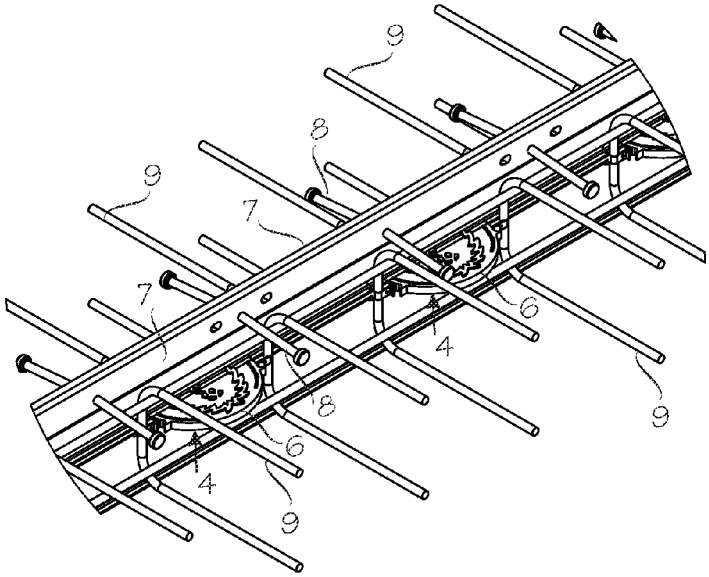
FIG. 31 shows a perspective view of the embodiment of FIGS. 29 and 30.

FIGS. 29 to 31 show a fifth embodiment of the invention. In these figures, the same reference numerals are used at corresponding points as in the previous examples. In the embodiment of FIGS. 29 to 31, the shear reinforcements 9 are formed of substantially U-shaped elements. In this embodiment, the U-shaped elements are attached by the area between their vertical parts to the thin c-shaped vertical part of the expansion reinforcement. This c-shaped vertical part is on both sides, as shown in the figure. In this embodiment as well, the shear reinforcements extend to both sides of the dowel in the vertical direction.

The above embodiment examples are not, by any means, intended to restrict the invention but different implementations are also feasible. The invention may be varied completely freely within the scope of the claims. The structure of the expansion joint reinforcement may naturally also deviate from the examples shown in the figures.

The invention claimed is:

1. An expansion joint system of a concrete slab arrangement configured to reinforce concrete slabs, comprising a first concrete slab and a second concrete slab, and an expansion joint reinforcement disposed between the first concrete slab and the second concrete slab, the expansion joint reinforcement including at least one local dowel arranged to transfer loads which are perpendicular to the slab plane, and the at least one local dowel is formed of a circular dowel plate and a casing part partly surrounding the circular dowel plate, wherein the at least one local dowel is adhered to concrete of the second concrete slab via the casing part, the expansion joint reinforcement includes at least one shear reinforcement attached to the circular dowel plate or at least one prearranged attachment means for attaching a shear reinforcement to the circular dowel plate, and the expansion joint reinforcement includes at least one shear reinforcement attached to the casing part or at least one prearranged attachment means for attaching a shear reinforcement to the casing part.

2. An expansion joint system of a concrete slab arrangement according to claim 1, wherein a shear reinforcement or at least one prearranged attachment means for attaching a shear reinforcement to the expansion joint reinforcement is arranged in a part of the expansion joint reinforcement other than the dowel.

3. An expansion joint system of a concrete slab arrangement according to claim 1, wherein each dowel has at least one element that is arranged to form a shear reinforcement.

4. An expansion joint system of a concrete slab arrangement according to claim 1, wherein the shear reinforcements are formed by means of double-ended clenching pins.

5. An expansion joint system of a concrete slab arrangement according to claim 4, wherein the double-ended clenching pins are attached by the area between their ends to the dowel.

6. An expansion joint system of a concrete slab arrangement according to claim 4, wherein the double-ended clenching pins are attached by the point of the clenched part to a part of the expansion joint reinforcement.

7. An expansion joint system of a concrete slab arrangement according to claim 1, wherein the shear reinforcements are formed by means of circular elements having vertical parts.

8. An expansion joint system of a concrete slab arrangement according to claim 7, wherein the circular elements are attached by the area between the ends of their vertical parts to the dowel.

9. An expansion joint system of a concrete slab arrangement according to claim 1, wherein the shear reinforcements are formed of substantially U-shaped elements having two branches and a part connecting the two branches.

10. An expansion joint system of a concrete slab arrangement according to claim 9, wherein the U-shaped elements are attached by the area between the ends of the part connecting the two branches to the dowel.

* * * * *